United States Patent [19]

Racich

[11] Patent Number: 4,531,642

[45] Date of Patent: Jul. 30, 1985

[54] PORTABLE DESK

[75] Inventor: John J. Racich, Joliet, Ill.

[73] Assignee: G Q Games, Inc., Joliet, Ill.

[21] Appl. No.: 567,667

[22] Filed: Jan. 3, 1984

[51] Int. Cl.[3] ..... A47B 65/00

[52] U.S. Cl. ..... 211/42; 248/451

[58] Field of Search ..... 211/42, 69.1; 248/346, 248/441, 445, 446, 447, 460, 463, 451, 454–457, 465

[56] References Cited

U.S. PATENT DOCUMENTS

| | | | |
|---|---|---|---|
| 637,745 | 11/1899 | Brouse | 248/463 X |
| 1,117,386 | 11/1914 | Hughes | 248/446 |
| 3,200,791 | 8/1965 | Swett | 248/447 |
| 3,381,825 | 5/1968 | Bessett | 211/74 |
| 4,176,743 | 12/1979 | Fitzpatrick | 211/60.1 X |

*Primary Examiner*—Ramon S. Britts
*Assistant Examiner*—Sarah A. Lechok
*Attorney, Agent, or Firm*—John L. Parker

[57] ABSTRACT

The invention described herein is a portable desk board having upper and lower portions and two longitudinally spaced, flat-top working areas, with a receptacle for writing instruments and the like separating the working areas longitudinally. An elongated bookrest is arranged in the lower portion of the desk, and a pivot is provided for mounting the bookrest to the desk. The outer end of the bookrest may be selectively anchored in one of two positions on the desk board. The desk board includes a clamp along its upper portion to overlie each of the spaced working areas for clamping paper or the like in place over the respective working area, and a hand grip carrier is provided in the central upper portion of the desk board. A stand is provided for the desk board operable between open and closed positions and comprising a pair of arms with a flexible strap extending therebetween to provide a support for the desk when the stand is open and a carrier for the desk board when the stand is closed. A specially shaped board margin is provided for contact with the flexible strap to lock the strap against the board when the desk stand is not needed and to also provide a hand grip for carrying the board. An alternative form of the invention is also disclosed, having a differently constructed arm means on the desk stand, as well as other differences in construction.

7 Claims, 13 Drawing Figures

10
11
11a
11b
12
14
14a
14b
15
16
18
19
20
21
22
24
25
26
28
29
30
31
31a
31b
31c
32
34
35
36
3
4
5
x
y
z
r
s

FIG. 8
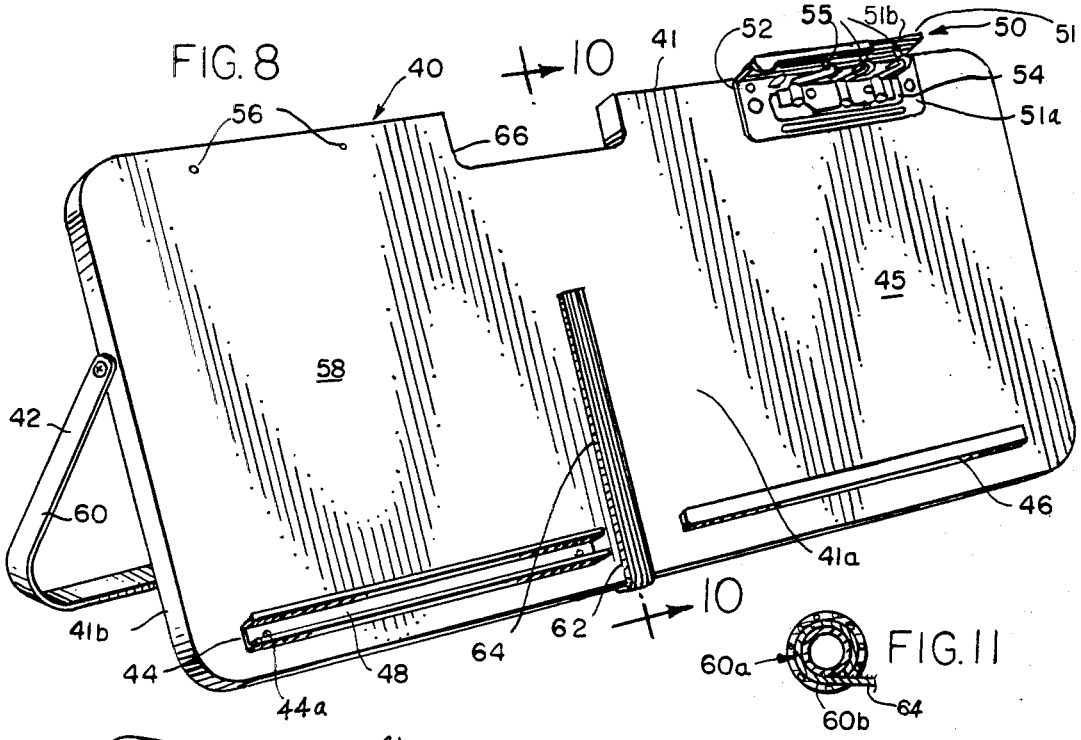
FIG. 11
FIG. 9
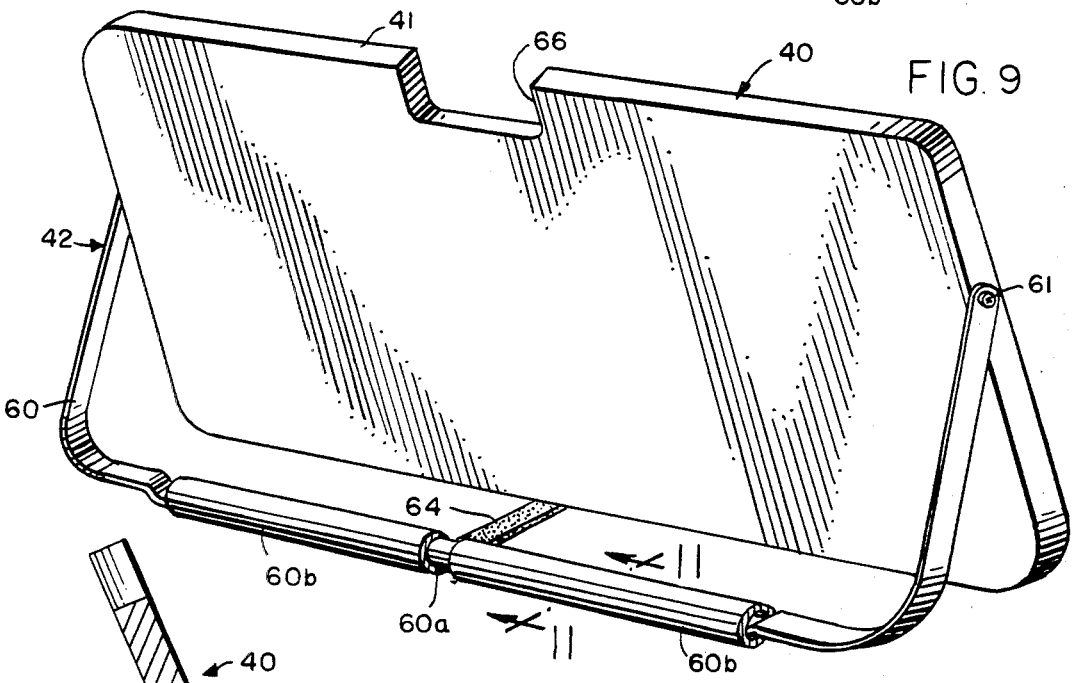
FIG. 10
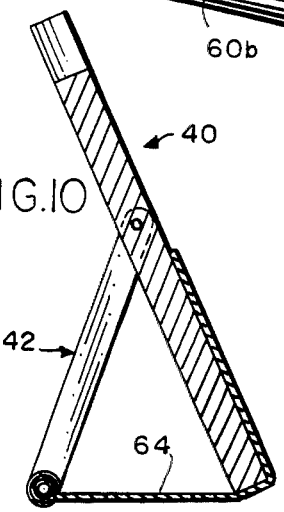
FIG. 12
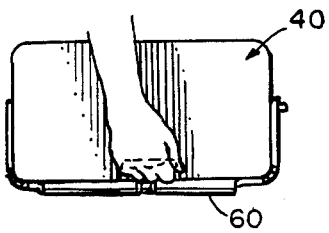
FIG. 13
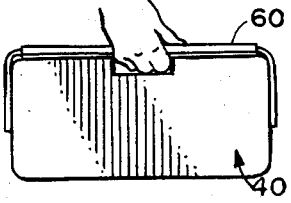

PORTABLE DESK

DESCRIPTION OF THE INVENTION

This invention relates generally to desks for holding books and the like, and more particularly to such desks which are multi-functional as well as portable.

It is a principal object of the present invention to provide a general purpose portable desk which may be freely held by a student or the like in any position desired, or alternatively which may be supported on a conventional horizontal support surface by means of an integral stand. An allied object of the invention is to provide a multi-functional portable desk which may be held on a student's lap or at any other non-conventional angle, such as placement on a floor, chair or bed for use by a student while leaning, sitting or lying down. Yet another object of the invention is to provide a portable desk which not only need not assume the attitude of a standard desk, table or the like, but which may be adjusted so that it is inclined at any angle or posture desired.

An ancillary object of the invention is to provide such a portable desk having a storage area for pencils and the like which is conveniently located on the desk for ready access and yet is not located so as to interfere with the working areas of the desk. Another object of the invention is to provide such a portable desk which is capable of supporting a book while at the same time providing a work place alongside the book for note taking or the like. Still another object of the invention is to provide such a portable desk which is readily adaptable for comfortable use by either a right-handed or left-handed student.

Yet another object of the invention is to provide a portable desk which is extremely light in weight and compact, neatly fits under the arm of a student or the like, and is capable of being carried by the student in either of two facile ways.

The foregoing and other objects, advantages and functions of the invention will be apparent on reference to the specification and to the attached drawings illustrating a preferred embodiment of the invention.

In the drawings, FIG. 1 is a front perspective view of an illustrative portable desk having the features of the invention, showing the desk in a work position, ready for use by a student or the like.

FIG. 8 is a front perspective view similar to FIG. 1, but showing an alternative form of the illustrative portable desk of the invention, also showing the desk in a work position, ready for use by a student.

FIG. 9 is a rear perspective view of the portable desk form illustrated in FIG. 8.

FIG. 10 is a vertical sectional view taken along the line 10—10 in FIG. 8.

FIG. 11 is a vertical cross-sectional view taken along the line 11—11 in FIG. 9.

FIG. 12 is an elevational view showing the illustrative portable desk of FIG. 8 while being transported from one location to another (with hand of person carrying desk shown in fragmentary fashion). FIG. 13 is an elevational view similar to FIG. 12, but illustrating a different manner of holding the portable desk for transport.

Figures 1, 2, 3, 4, 5, 6, 7:
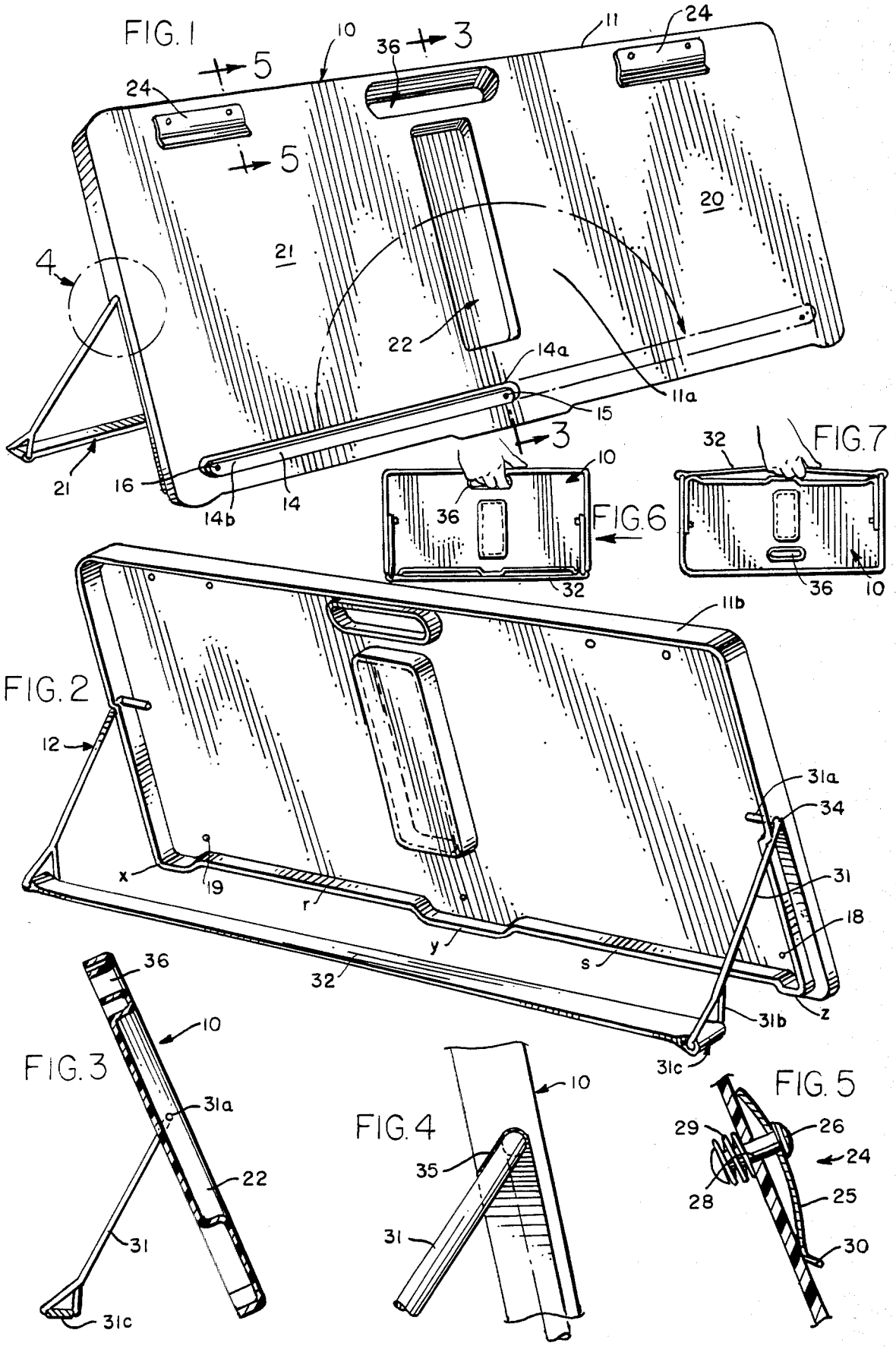
FIG. 2 is a rear perspective view of the portable desk illustrated in FIG. 1.
FIG. 3 is a vertical sectional view taken along the line 3—3 in FIG. 1.
FIG. 4 is an enlarged, fragmentary elevational view of the encircled portion at the left-hand side of FIG. 1, showing the manner in which the desk board may be supported at an inclined angle to a supporting surface (not shown).
FIG. 5 is an enlarged, fragmentary, cross-sectional view taken along the line 5—5 in FIG. 1, showing the details of an illustrative spring clip mechanism provided on the desk board.
FIG. 6 is an elevational view showing the illustrative portable desk while being transported from one location to another (with hand of person carrying desk shown in fragmentary fashion).
FIG. 7 is an elevational view similar to FIG. 6, but illustrating a different manner of holding the portable desk for transport.

While the invention will be described in connection with certain preferred embodiments, it will be understood that I do not intend to limit the invention to those embodiments. On the contrary, I intend to cover all alternatives, modifications, and equivalents as may be included within the spirit and scope of the invention.

Turning now to the drawings, there is shown in FIG. 1 an illustrative portable desk 10 including a desk board 11 and an integral desk stand 12, with the board being shown supported by the stand in an illustrative upright work position at an approximate 30 degree angle with respect to the vertical. As shown, the illustrative desk board 11 is of generally rectangular configuration, formed of thin, molded plastic sheeting. The desk board 11 includes a central planar portion **11*a* providing flat-top working areas or surfaces, which portion is surrounded by a peripheral margin 11*b* turned at a 90 degree angle to the planar portion thereby adding to the structural strength of the board. The desk board 11 is described in terms of its upper and lower portions as depicted in FIG. 1**.

In carrying out the invention, an adjustable bookrest 14 is mounted along the lower edge of the desk board 11 as shown in FIG. 1. The bookrest 14 is of generally elongated construction, formed of metal or plastic as desired, and having inner **14*a* and outer 14*b* ends. The inner end 14*a* of the bookrest is pivotably secured to the center of the lower portion of the board 11 by means of an attachment 15. The outer end 14*b* of the bookrest carries an appropriate pin or projection 16 for lockable and releasable engagement with openings or recesses 18, 19 provided near the longitudinal ends of the lower portion of the board. As shown in FIG. 1, the bookrest 14 is in place on the left-hand side of the desk board 11, with the projection 16 engaged in the board opening 18. Thus, the bookrest 14 is in a position such that it may be used to support a book or the like (not shown) on the left-hand side of the desk board. In keeping with the invention, this bookrest 14 arrangement provides a workplace area 20 on the right-hand side of the board 11 adjacent and to the right of the area where the book is located. While studying a book in place on the left side of the board, a right-handed student may easily take notes, for example, on a piece of paper (also not shown) placed in the workplace area 20** on the right side of the board.

One of the features of the invention is that the bookrest 14 may be easily shifted from the left side of the board 11 to the right side. This is accomplished through the simple expedient of the student or operator manually lifting the outer end **14*b* of the bookrest slightly in order to lift and thereby disengage the projection 16** carried therein from its corresponding opening 18 in the board (a small amount of "play" is usually provided in the attachment 15 to accommodate such movement), and then swinging the outer end of the bookrest in a 180 degree arc about the central pivot mounting 15 until the bookrest projection 16 is aligned with the board opening 20 provided at the right-hand portion of the board. The bookrest 14 may then be anchored in place by inserting and releasably locking the projection 16 into the board opening 20. Once the bookrest 14 is in place along the lower right-hand portion of the desk board 11, the bookrest is in a position to hold a book (again, not shown) in place on the right-hand side of the desk board (i.e., over the working area 20). As the desk board 11 is thus used, a left-handed person may readily take notes on a workplace area 21 located opposite the area 20 described previously. It will thus be seen that the desk board of the invention may be used equally well by left-handed or right-handed persons through use of my two-position bookrest arrangement.

Another feature of the illustrative portable desk 10 is the provision of means for separating the working areas 20, 21 from each other longitudinally, comprising a vertically arranged central recessed or indented portion 22 on the board 11. The central recess 22 functions to separate the right and left portions of the board (e.g., areas 20 and 21), and at the same time provides a central repository or receptacle for holding pencils, pens, erasers and the like (not shown). In this way, writing implements may be kept readily at hand for use by the student; yet they are centrally located so that there is no obstruction of the working or book holding areas 20, 21.

In keeping with another feature of the invention, clamping means is provided on the upper portion of the desk board 11 associated with each workplace area 20, 21 for releasably gripping a book, paper or the like. As shown, each clamping means constitutes a spring clip mechanism 24 mounted near the edge of the upper portion of the desk board 11. One clip 24 is located above the right side workplace area 20, and one clip is located above the left side workplace area 21.

As illustrated, each spring clip mechanism 24 comprises a thin, slightly curved metal clip 25 of generally rectangular shape secured to the board 11 by way of a longitudinally spaced pair of double-headed rivets 26 which extend through suitable recesses 28 in the board. Each rivet 26 is disposed with its outer rivet head against the clip 25, and has a coil spring 29 interposed between the inner rivet head and the board 11. In this way, each arcuate metal clip 25 is spring biased with respect to the front of the board 11. See FIG. 5. A lip 30 is provided along the lower leading edge of the metal clip 25 to facilitate hand gripping of the clip. Thus, each illustrative spring clip mechanism 24 is operable through the simple expedient of a student gripping the lip 30 with thumb and forefinger and pulling the clip 25 upwardly against the bias of the compression springs 29 so that a book or sheet of paper or the like may then be inserted within and grasped by the clip. Of course, it will be understood that other types of clips of conventional construction may also be used as effectively in carrying out my invention.

Thus, for example, a right-handed student may choose to use my portable desk by placing a book (not shown) on the bookrest 14 while in the position shown in FIG. 1, and then by placing a notebook or sheet of paper within the spring clip 24 provided above the right side workplace area 20. As the student reads the book placed on the left side of the board, he may make notes of what he reads on the paper held at the right side of the board. The student's hands are of course free to make notes or the like since there is no need for the student to hold either the book or the paper.

Turning now to yet another feature of the invention, a dual function desk stand or backrest 12 is provided. In this instance, the backrest 12 is constructed so as to support the desk board 11 at any selected angle during desk use. When the desk is no longer being used, the backrest 12 doubles as a device for carrying the desk from one location to another as explained below. As shown, the desk stand 12 includes a wire arm 31 located at each longitudinal end of the board 11. Each arm has an L-shaped inner end **31*a* swingably mounted to the end of the desk board 11, and an outer end 31*b* adapted to lie flat against an appropriate supporting surface for the desk board (not shown). Each outer end 31*b* of the arm is loop-shaped, having a flat bottom portion 31*c*. A flexible strap 32 is stretched between and secured to the outer ends 31*b* of the arms to complete the desk stand structure. Swingable motion of each wire arm 31 with respect to the desk board 11 is accomplished by rotatably mounting each L-shaped inner arm end 31*a* through a corresponding opening 34 provided in the adjacent margin 11*b* of the board (see FIGS. 2–4). The extent of swingable movement of the arms 31 with respect to the desk board 11 is limited by contact between the arm and an abutment 35 provided in the adjacent board margin 11*b* (see FIG. 4). Slight compression is desirably created between the wire arms 31 by shortening the length of the flexible strap 32 sufficiently to snug up the relationship between the arms and the adjacent portions of the board margin 11*b*** against which the arms are compressed.

Thus, the desk board 11 may be supported at any desired angle with respect to a table, floor or the like by swingably adjusting the arms 31 to an extended position in relation to the plane of the board 11. Conversely, the desk stand 12 may be folded against the board 11 by swinging the arms 31 back toward the board. Locking of the desk stand 12 against the board 11 is accomplished by juxtaposing the flexible strap 32 over the bottom surfaces of the board margin **11*b***, as described below.

Means is provided along the bottom surfaces of the board margin **11*b* for locking the flexible strap 32 against the board when the backrest 12 has been moved to a closed position, as well as for affording a hand grip carrier for the portable desk. As shown (see FIGS. 2 and 7), this means comprises several flat recessed portions r and s of the bottom surface of the board margin 11*b*, which portions define several flat extended portions or lands x, y and z which are engaged by the flexible strap 32 when the strap is folded to a closed position against the board. The strap 32 is thus locked against the board margin through frictional engagement of the strap with the lands x, y and z. By the same token, the recessed portions r and s intermediate the lands x, y and z, define spaces between the board margin 11*b* and the strap 32 which are sufficiently sized to receive a student's hand so that the student may grip the strap for the purpose of carrying the board from one place to another. The flexible strap 32** thus performs the dual function of a support member, and a carrying member, for the board.

In further keeping with the invention, I provide a longitudinally elongated hand hole 36 located along the marginal upper portion of the board 11, and preferably disposed near the center of the length of the board. See FIGS. 1 and 6. This hand hole 36 provides a grip for a student to use in transporting the desk board from one place to another. My desk 10 may thus be readily gripped for quickly and easily moving the desk as desired either using the hand hole 36 (FIG. 6), or by way of the flexible strap 32 (FIG. 7).

In the alternative embodiment of FIGS. 8–13, an illustrative portable desk 40 including a desk board 41 and an integral desk stand 42 is shown, with the board being shown supported by the stand in an illustrative upright work position, again at an approximate 30 degree angle with respect to the vertical. The illustrative desk board 41 is also of generally rectangular configuration, and may be formed of a wide variety of construction materials such as wood, metal or plastics (e.g., rigid polyurethane foam). The desk board 41 includes a central planar portion 41*a* providing flat-top working areas or surfaces, which portion is surrounded by a peripheral board edge 41*b*. The desk board 41 is described in terms of its upper and lower portions as depicted in FIG. 8.

In this embodiment, a bookrest 44 is mounted along the lower edge of the left-hand portion of desk board 41 as shown in FIG. 8. The bookrest 44 is of generally elongated construction, formed of metal or plastic as desired, and is secured by suitable fasteners 44*a* or adhesive (not shown) to the board. As shown in FIG. 8, the bookrest 44 is in place on the left-hand side of the desk board 41 such that it may be used to support a book or the like (not shown) on the left-hand side of the board. Once more, in keeping with the invention, this bookrest 44 arrangement provides a workplace area 45 on the right-hand side of the board 41 adjacent and to the right of the area where the book is located. Thus, while studying a book in place on the left side of the board, a right-handed student may easily take notes, for example, on a piece of paper (also not shown) placed in the workplace area 45 on the right side of the board. An elongated ledge 46, formed of plastic, wood or other suitable material, may be secured as desired (e.g., by way of fasteners (not shown) or adhesive) along the lower edge of the right-hand portion of the desk board 41 to facilitate holding sheets of paper (not shown) or the like in place.

One of the features of this embodiment of the invention is that the bookrest 44 has a C-shaped transverse cross-section (see FIG. 8), so as to define a repository or receptacle 48 for holding pencils, pens, erasers and the like (not shown). Writing implements may thus be kept readily at hand for use by the student; yet they are located along the lower portion of the board so that there is no obstruction of the working or book holding areas.

In the alternative form of the invention shown in FIGS. 8–13, clamping means is provided on the upper portion of the desk board 41 associated with the workplace area 45 for releasably gripping a book, paper or the like. As shown, the clamping means includes a spring clip mechanism 50 secured near the edge of the upper portion of the desk board 41. As illustrated, the spring clip mechanism 50 includes an L-shaped plate 51 one leg 51*a* of which is secured to the board 41 by way of suitable fasteners 52 and the other leg 51*b* of which is upstanding. Secured to the upstanding leg 51*b* of the plate is a clamping member 54 which may be lowered or raised with respect to the plate leg 51*b* by means of a lever 55. The lever 55 is spring biased to the upstanding plate leg 51*b* so that the lever may be locked into place alongside the upstanding plate leg when the spring mechanism has been closed tightly. Once more, it will be understood that other types of clips of conventional construction may also be used as effectively in carrying out my invention.

Thus, as shown in FIGS. 8–13, a right-handed student may use my portable desk by placing a book (not shown) on the bookrest 44 while in the position shown in FIG. 8, and then by placing a notebook or sheet of paper within the spring clip 50 provided above the right side workplace area 45. As the student reads the book placed on the left side of the board, he may make notes of what he reads on the paper held at the right side of the board. The student's hands are again free to make notes or the like since there is no need for the student to hold either the book or the paper.

In this alternative form of the invention, means is provided for quickly and easily adapting the desk board for use either by a right-handed or a left-handed person. Thus, as shown in FIGS. 8–13, the desk board is set for use by a right-handed person, with the bookrest 44 being in place beneath the left-hand portion of the board, the ledge 46 in place beneath the right-hand portion of the board, and the spring clip mechanism 50 being positioned over the right-hand portion of the board for holding note paper and the like. For the purpose of converting the board for use by a left-handed person, the board is provided with additional holes 56 in the upper portion of its left-hand side, so that the fasteners 52 associated with the spring clip mechanism 50 may be removed, as with a screw driver, and the spring clip mechanism then easily transferred over to the upper portion of the left-hand side of the board. Likewise, the bookrest 44 may readily be removed from the position shown in FIGS. 8–13, by removing the screws 44*a*, and moved over to the lower right-hand portion of the desk board in place of the ledge 46. Of course, in this event, the ledge 46 shown in FIGS. 8–13 on the right-hand side of the board will be moved over to the left-hand side of the board replacing the bookrest 44. In this condition, the board is fully useful by a left-handed person, i.e., with a book or the like arranged on the right-hand side of the board held in place by the bookrest, and with the spring clip mechanism 50 for note paper and the like and the ledge 46 being positioned on the left-hand side of the board just above and beneath a left-side workplace area 58.

Turning now to the integral desk stand 42 of FIGS. 8–13, once again a dual function desk stand or backrest 42 is provided. As before, the backrest 42 is constructed so as to support the desk board 41 at any selected angle during desk use. When the desk is no longer being used, the backrest 42 doubles as a device for carrying the desk from one location to another as explained below. As shown, the desk stand 42 includes arm means 60 which is curved in a U-shape so that it fits around a portion of the peripheral board edge 41*b*, with the ends of the arm means being swingably secured to the longitudinal ends of the board as by screws 61 or other fasteners. The ends of the arm means 60 as shown are of flat metal construction. In order to enhance the rigidity of the stand, the central portion 60*a* of the arm means is of tubular construction with the tubular portion being enclosed within an outer sponge rubber covering 60*b*. The U-curvature dimensions of the arm means 60 are chosen such that the arm closely and frictionally engages the board edge 41*b* when the stand is placed in a closed position.

The stand 42 is held in position by fasteners 62, 64 which are formed of two cohesive fabrics which adhere when pressed together. One of these fabrics has a plurality of tiny plastic hooks and the other fabric has a plurality of tiny plastic loops. The hooks releasably engage the loops when the fabrics are pressed together. One type of such fasteners is marketed under the trade mark VELCRO. A rectangular piece of VELCRO fastener 62 is attached to the central portion of the tube 60*a* by a heat resistant adhesive. A mating piece of VELCRO fastener 64 is also adhesively attached to the central portion of the top surface of the desk board 41 to form the other or mating part of the fastener.

In operation, the arm 60 is swung about the pivot point defined by the fasteners 61 to the desired angle with respect to the desk board (for example, 30 degrees). Then, the stand arm 60 is fixed in the chosen relationship with respect to the desk board 41 through the simple expedient of the operator or user pressing the VELCRO fasteners 62, 64 together. It will be understood that while VELCRO fasteners are described and shown, other types of fasteners could be used as well. For example, eyelets could be placed on one mating surface and springs could be attached to the other to pass through and hook onto the eyelets.

In further carrying out the invention, I provide a cut-out hand hole 66 located along the marginal upper portion of the board 41, and again preferably disposed near the center of the length of the board. This hand hole 66 provides a grip for a student to use in transporting the desk board from one place to another, either with the hand hole down (FIG. 12) or with the hand hole up (FIG. 13).

Thus, the desk board 41 may be supported at any desired angle with respect to a table, floor or the like by swingably adjusting the arm means 60 to an extended position in relation to the plane of the board. Conversely, the desk stand 42 may be folded against the board 41 by swinging the arm 60 back toward the board. Locking of the desk stand 42 against the board 41 is accomplished by juxtaposing the arm 60 over the peripheral board edge 41*b*. When locked against the board 41, the stand 42 also affords a hand grip carrier for the portable desk. The arm means 60 thus performs the dual function of a support member, and a carrying member, for the board.

Of course, it will be understood that my invention includes various alternatives and modifications. For example, my desk board 11 or 41 may be formed of light weight plastics, such as styrene or polyurethane. Alternatively, it may be formed of any suitable material such as wood, particle board or metal. Likewise, the thickness and shape of the board may vary somewhat with the type of construction material used. As will be seen from the above description, I have provided a multifunctional portable desk which is uniquely adapted for a student to hold on his or her lap and which is readily movable to any position or location.

I claim as my invention:

1. A portable desk comprising, in combination, a rectangular, planar desk board having upper and lower portions and providing two longitudinally spaced, flat-top working areas, said flat-top working areas occupying a major portion of the surface area of the desk board, means comprising a receptacle for writing instruments and the like located on the desk board adjacent to the working areas, an elongated bookrest arranged in the lower portion of the desk board to underlie one of the working areas, clamping means provided along the upper portion of the desk board to overlie one of the spaced working areas for clamping a book, paper or the like in place over said working area, and hand grip carrying means for the portable desk located in the central upper portion of the desk board; and a stand for said desk board operable between open and closed positions and comprising arm means swingably secured to the longitudinal ends of the desk board, and means provided along the lower portion of the board for cooperating with the arm means to lock said arm means against the board when the stand is in closed position as well as to afford a hand grip carrier for the portable desk.

2. The portable desk defined in claim 1, in which the receptacle means is interposed between and separates the working areas longitudinally.

3. The portable desk defined in claim 1, in which the receptacle means is integral with the elongated bookrest.

4. The portable desk defined in claim 1, in which the elongated bookrest has inner and outer ends and the desk includes pivot means for mounting the inner end of said bookrest to the central lower portion of the desk board, means for selectively anchoring the outer end of said bookrest in one of two positions on the desk board, said means including a projection carried by the bookrest outer end, first recess means located near one longitudinal end of the desk board, and second recess means located near the other longitudinal end of the desk board for selectively releasably receiving the projection, the outer end of said bookrest being swingable 180 degrees about said pivot means between (a) one position in which said projection is engageable with said first recess means whereby the bookrest is positioned to underlie one of said working areas, and (b) a second position in which said projection is engageable with said second recess means whereby the bookrest is positioned to underlie the other of said working areas.

5. The portable desk defined in claim 1, in which the clamping means is a spring clamp.

6. The portable desk defined in claim 1, in which the means provided along the lower portion of the board for cooperating with the arm means to lock the arm means against the board when the stand is closed as well as to afford a hand grip carrier for the desk comprises a plurality of alternating recessed and extended portions of the bottom surface of the desk board with the extended portions being engaged by the flexible strap and the recessed portions defining spaces between the desk board and the strap for accommodating a person's hand to grip the portable desk.

7. The portable desk defined in claim 1, in which the means provided along the lower portion of the board for cooperating with the arm means to lock the arm means against the board when the stand is closed as well as to afford a hand grip carrier for the desk comprises a pair of cohesive fabrics which adhere when pressed together, with one such fabric adhered to the arm means and the other such fabric adhered to the board.

* * * * *